US011079194B1

(12) United States Patent
Sinnema

(10) Patent No.: US 11,079,194 B1
(45) Date of Patent: Aug. 3, 2021

(54) CARBON FIBER BARREL SLEEVE RESILIENTLY BONDED TO STEEL LINER AND METHOD OF CONSTRUCTION

(71) Applicant: Benchmark Barrels, LLC, Arlington, WA (US)

(72) Inventor: Ronald T. Sinnema, Arlington, WA (US)

(73) Assignee: Benchmark Barrels, LLC, Arlington, WA (US)

( * ) Notice: Subject to any disclaimer, the term of this patent is extended or adjusted under 35 U.S.C. 154(b) by 0 days.

(21) Appl. No.: 16/820,041

(22) Filed: Mar. 16, 2020

(51) Int. Cl.
*F41A 21/02* (2006.01)
*F41A 21/20* (2006.01)
*F41A 21/44* (2006.01)
*F41A 21/24* (2006.01)

(52) U.S. Cl.
CPC ..... *F41A 21/02* (2013.01); *F41A 21/20* (2013.01); *F41A 21/24* (2013.01); *F41A 21/44* (2013.01)

(58) Field of Classification Search
CPC ..... F41A 21/02; F41A 21/04; F41A 21/20; F41A 21/24
USPC ..... 42/76.02, 78, 76.1; 89/14.7, 16
See application file for complete search history.

(56) References Cited

U.S. PATENT DOCUMENTS

| | | | | | |
|---|---|---|---|---|---|
| 2,137,259 | A * | 11/1938 | Boak | F41A 21/02 | 42/76.02 |
| 2,981,155 | A * | 4/1961 | Parlanti | F41A 21/20 | 89/16 |
| 4,485,721 | A * | 12/1984 | Shankhla | F41A 21/02 | 89/15 |
| 4,685,236 | A * | 8/1987 | May | F41A 21/02 | 42/76.02 |
| 5,355,765 | A * | 10/1994 | Rogers | F41A 13/12 | 89/14.4 |
| 5,600,912 | A * | 2/1997 | Smith | F41A 21/02 | 42/76.01 |
| 5,928,799 | A * | 7/1999 | Sherman | B32B 15/00 | 428/655 |
| 2016/0003570 | A1* | 1/2016 | Tonkin | F41A 21/04 | 89/14.4 |
| 2019/0226786 | A1* | 7/2019 | Sloan | F41A 21/28 | |

* cited by examiner

*Primary Examiner* — Bret Hayes
(74) *Attorney, Agent, or Firm* — Williams Kastner & Gibbs PLLC; Mark Lawrence Lorbiecki

(57) ABSTRACT

A method for forming and a carbon fiber barrel sleeve resiliently bonded to steel liner includes providing a rifle barrel having thickened walls and a mandrel blank. Each of the barrel and blank are turned to form a barrel liner and a mandrel, respectively, such that each has a substantially identical contour. The barrel liner is stress relieved to eliminate stresses within the molecular structure of the barrel liner. A plurality of flutes are cut into an exterior surface of the barrel liner; the depth of each flute being at least equal to the depth of the flute. A plurality of layers of carbon fiber fabric are laid up on the mandrel to form a sheath which is cured and bonded to the barrel liner with a continuous bond of high temperature adhesive at tips of the fins. The bonded sheath and barrel liner forming a rifle barrel.

20 Claims, 5 Drawing Sheets

CARBON FIBER BARREL SLEEVE RESILIENTLY BONDED TO STEEL LINER AND METHOD OF CONSTRUCTION

FIELD OF THE INVENTION

The method for construction and resulting barrel assembly is disclosed as barrel formation technology, and specifically relates to formation of a barrel having a carbon fiber sheath.

BACKGROUND OF THE INVENTION

It has been long understood that a rifle's barrel changes shape and moves in multiple directions every time it is fired. These barrel motions coupled with shot to shot pressure variations greatly affect how well a particular barrel and load combination will shoot.

Builders of accurate rifles agree if the barrel's movement cannot be eliminated, the next best thing is that it move consistently with each shot. That is why good shooting rifles have stiff barrels and their actions are firmly bedded in the stock while the stock is configured such that nothing touches the barrel in front of the receiver (free floating) eliminating any deformation of the barrel under the stress imparted by the shot pressure.

Shooters often talk about another form of barrel movement sometimes referred to as "ringing." There is no doubt a short stout bench rest barrel whips less than those of a typical hunting rifle. Unlike hunting rifles, bench rest barrels seem more forgiving with extremely wide "sweet spots." Indeed, a good bench rest barrel may have only a few narrow velocity zones where it does not shoot well. Thus, one can understand that the greater rigidity provided by stout barrel walls lends precision to the shot path.

When each shot is fired the chamber swells and produces an "annular wave" or "pressure pulse" which then bounces back and forth between the muzzle and receiver. This "P" wave is like a "doughnut" traveling up and down the barrel and opens the bore diameter slightly so if the bullet exits the barrel coincidentally with the wave at the muzzle, the barrel will behave as if it has a bad crown. If the bullet exits the barrel coincidentally with the P wave, and the muzzle is moving off axis, exhausting gases would immediately push the bullet into a yaw as if the barrel had a bad crown. A stout stiff barrel can resist the forces of the P wave and minimize its effect on the path of a bullet passing through that barrel.

Carbon fiber has long been hailed across many industries—aerospace, cycling, alternative energy—as a wonder material making everything lighter and stronger. When employed in a rifle barrel the benefits extend beyond reducing weight and increasing strength. Aerospace-grade carbon fiber is 10 times stronger than stainless steel and has a specific stiffness nearly 6 times greater than that of steel. In conventional configuration, the manufacturing process begins with a full-profile steel barrel blank which are then lathe-turned down to a significantly reduced profile thereby greatly reducing weight of the barrel liner. But, with the removal of material, the rigidity of the barrel is compromised. The more material that is removed to match a desired contour, the less rigid the resulting barrel. The reduced contour barrel is then wrapped with a carbon fiber impregnated with matrix resin. In such a conventional configuration, carbon fiber besides imparting stiffness, the carbon fiber has an ability to diffuse heat along the length of the barrel. Carbon fiber moves heat very effectively through the wall of the barrel greatly increasing heat transport. Conventional barrels so made cool faster that the stout walled barrels, though barrels with more material have a capacity to absorb more heat than the resulting thin walled contoured barrels. Carbon fiber wrapped barrels maintain accuracy over longer sessions of fire because of their ability to dump heat energy and are more durable than unsupported steel barrels.

But, this conventional method and construction paradigm does suffer from internal stresses introduced both by the method of construction and by the inherent differential between the positive and dominating thermal expansion coefficient of steel as opposed to the neutral or, indeed, negative thermal expansion coefficient of carbon fiber. When heated, these two materials expand at different rates, imparting a bending impetus thereby deflecting the steel barrel liner to curl about the unexpanded carbon fiber material. In conventional construction, this bending force is balanced by design so as to place the steel barrel placing the stresses imparted in dynamic opposition on to another; the arrangement succeeding in keeping the barrel aligned where generally equal disposition of the stresses in a symmetric organization allowing the carbon fiber to exert even stresses in opposed directions. Such a stressed barrel, however, is especially susceptible to barrel whip in response to the P wave.

The conventional carbon fiber-wrapped or reinforced barrel offerings all appear to exhibit accuracy issues as they heat up from use and tend to deform when subjected to the heat from repeated consecutive firings. The deformation of the barrel often further results from, for example, unequal application of the carbon fiber (the excess tends to form in a line and is known as a "spine"), resulting from the dimensions and production of the steel barrel liner in conjunction with the method of applying the outer carbon fiber wrap or shell.

One method of affixing the carbon fiber to the steel barrel liner is by wrapping carbon fiber, however, that process can actually bend the barrel during that wrapping. The tension used to remove voids from the laid up carbon fibers pulls the barrel in the direction of the fiber. The greater the tension the fewer the void, the more uniform the layup but the greater the stress imparted upon the barrel.

Another method of conventional construction used to form a carbon fiber tube is to do so separately, and then to slide the tube over the steel barrel liner. In such a method, stops on the steel barrel liner fix the tube relative to the liner by capturing the tube at respective ends. To overcome issues of thermal expansion the tube is held under sufficient tension to support the barrel liner with the rigid structure of the carbon fiber tube even after thermal expansion. The capture is facilitated by a tensioning nut placing longitudinal stress on the steel barrel thereby causing the resulting barrel to be a structure held in line by a calculated and equal stress around the perimeter of the barrel. By analogy, the conventional carbon fiber sleeve supports the barrel much as shrouds and guy wire support the mast of a sailboat by drawing the mast in force against the hull of the sailboat. It is the balanced tensioning the cylindrical sleeve imparts that holds the barrel against its compressive strength. But the compressive stresses imparted on the barrel are great.

Both of these methods exploit opposing stresses. Because those opposing stresses may exhibit varying degrees of inconsistent behavior, accuracy may change as repeated firings heat the barrel assembly. Because of the differing materials' reaction to heat changes the relative lengths of the carbon fiber and steel liner, the barrel may bend away from its starting position when cool. Though marginally acceptable in applications where only 2-3 consecutives shots are fired, these barrels exhibit a migration of the point of impact after repeated firings.

While the unequal stresses introduced by conventional means do introduce undue deformation, this deforming tendency is exacerbated when both the barrel and liner are selected to be of the lightest possible configuration. To lighten barrels, contours are shaped to have the thinnest possible walls as steel will allow (by exploiting the least amount of material either of steel or of carbon fiber, the resulting mass of the barrel is correspondingly reduced). Steel liners with thin walls do not have enough material configured to be accurate or maintain a consistent point of impact. If they did, the conventional thinking is that there would be no reason to wrap the barrel with carbon fiber. Conventional design seeks to exploit the carbon fiber to impart rigidity to the minimally stiff remaining steel. Conventional design of carbon fiber/steel barrels suffers from several shortcomings:

1. The longitudinal relationship between the carbon and the steel must change as the barrel is heated, because composites do not expand as steel does to heat.
2. The process of wrapping the carbon/composites around the relatively thin liner causes the barrel to bend as it is wrapped, and that bending leads to significantly shift the point of impact as the barrel is heated through use.
3. Conventional formation of the carbon fiber tubes is accomplished by wrapping carbon fiber around a forming mandrel to align the fibers in hoop-like fashion surrounding what would be the bore.

In the conventional assembled barrel, fibers are wrapped around, rather than along the barrel, forms fiber hoops such that the fiber adds less stiffness lengthwise to the barrel than would occur in a barrel formed by longitudinal laying of the fibers (aligned with the bore of the barrel). Such a configuration with hooped fibers allows the barrel to "whip" or reverberate harmonically in response to the impulse imparted by igniting the round in the chamber of the barrel.

What is needed in the art, is a method to form a more homogenous tube and a stiffer barrel liner, configured to better dissipate heat, and bonded in a method which allows the barrel liner to expand when heated by use without imparting undue stress imparted by the carbon fiber tube resulting in a stiffer, more stable and more predicable precision rifle barrel.

SUMMARY OF THE INVENTION

A method for forming and a carbon fiber barrel sleeve resiliently bonded to steel liner includes providing a rifle barrel having thickened walls and a mandrel blank. Each of the barrel and blank are turned to form a barrel liner and a mandrel, respectively, such that each has a substantially identical contour. The barrel liner is stress relieved to eliminate stresses within the molecular structure of the barrel liner. A plurality of flutes are cut into an exterior surface of the barrel liner; the depth of each flute being at least equal to the depth of the flute. A plurality of layers of carbon fiber fabric are laid up on the mandrel to form a sheath which is cured and bonded to the barrel liner with a continuous bond of high temperature adhesive at tips of the fins. The bonded sheath and barrel liner forming a rifle barrel.

In contrast to the conventional means of forming a carbon fiber barrel, the inventive method is designed to rely less upon the strength and stiffness of the carbon fiber and more upon rigidity resulting from deep fluting of a thick-walled liner. This deep fluting of the thick walls of liner provides more rigidity between the breach and muzzle. The "fluting" referred to herein describes the removal of material to leave structural ridges that extend longitudinally (though within the spirit of the instant invention, the structural ridges need not be straight, because, for example, spiral, interrupted, and other patterns of ridges are capable of providing the support intended). The inventive method and barrel assembly exploits ridges to retain much of the rigidity while removing weight from the barrel by fluting. This fluting allows the barrel liner to absorb more heat and expands more slowly than a smooth walled unfluted barrel of the same weight. Because there is more material to absorb heat than in a conventionally contoured barrel of the lightest configuration possible (therefore there is less expansion and less of the corresponding movement of the steel barrel liner relative to the carbon fiber sleeve). These slower heating and contraction cycles (because expansion is moderated by the additional amount of material) thereby preserve performance and enhance longevity; with less movement: thus, the barrel's point of aim is less affected in use.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
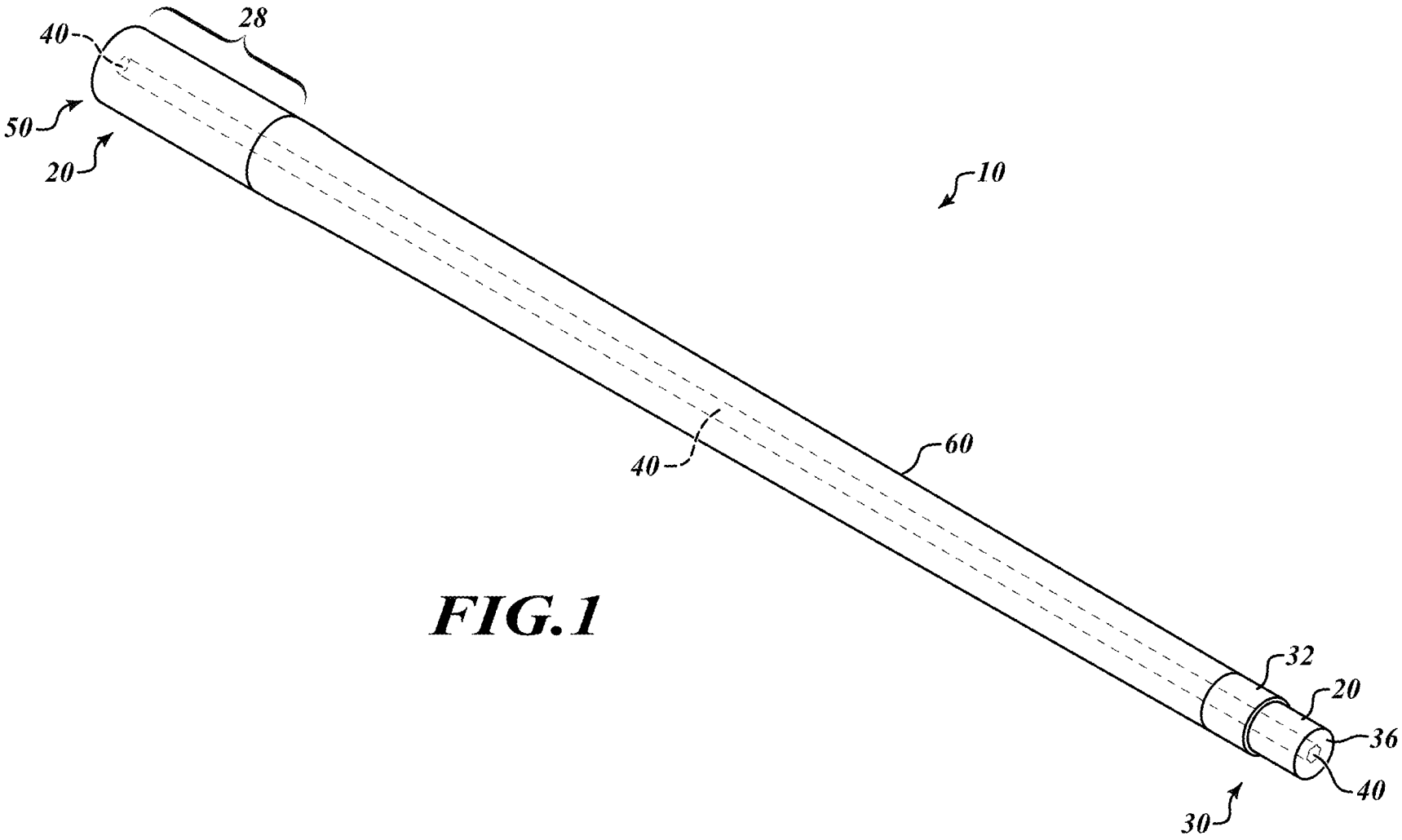
FIG. 1 is a perspective view of an inventive barrel assembly to specifically include a barrel liner, a carbon fiber sheath, and a threaded cap.
Figure 2:
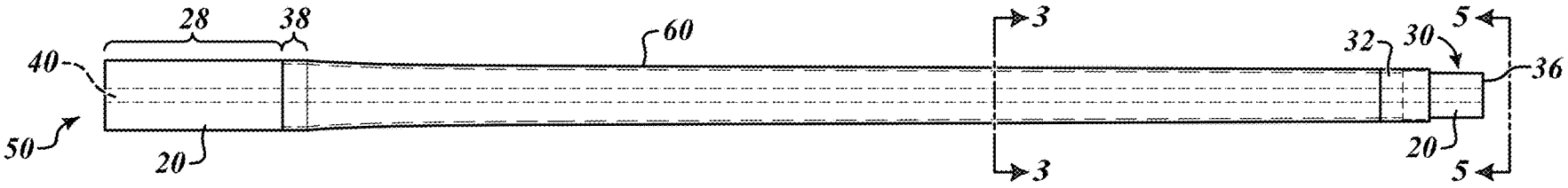
FIG. 2 is a plan view of the barrel assembly depicting distinct specific section sites.
Figure 5:
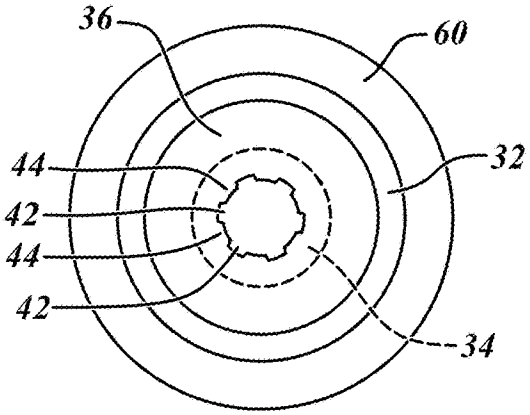
FIG. 5 is an end view depicting the inventive barrel assembly showing a muzzle face viewing down the bore to the breach.

By way of overview, embodiments of the inventive method and rifle barrel are formed by a method with very tight control over the variables necessary to properly form the carbon fiber sheath that envelopes the barrel liner:

1. Composite materials are wrapped around a tapered mandrel at a thickness prescribed for the specific contour/design. (There are numerous individual mandrel designs for different contours/configurations.) The dimensional relationship between the mandrel and the liner are such that the resulting composite "tube" is formed to achieve full contact with the steel barrel liner;

2. The composites and resin material are cured to achieve the highest possible longitudinal stiffness, restricting hoops, and uniformity along the length of the formed sheath. Materials are selected to allow high temperature use;
3. A structural steel liner is made to match the contour of the mandrel. The liner is "fluted" and material is removed by aggressive fluting while leaving longitudinal fins to maintain rigidity such that the desired stiffness to weight ratio is achieved;
4. The composite tube is formed to achieve a complete and full contact with the liner;
5. The composite tube is bonded to the liner with minimal bond gaps; and
6. A cap is made and threaded to the barrel to capture the composite tube as well to expose an extent of the barrel extending past the sheath that can be crowned and/or threaded for use of various muzzle devices. That part of the barrel liner that extends beyond the sheath serves as a steel "shoulder" serves as a steel protuberance at the extreme end of the barrel to protect the carbon fiber sheath; steel wearing better than carbon fiber composite in use.

Referring to FIGS. 1 through 11, there are specific structures described within the following disclosure wherein commonly used terms might require a more precise expression. To that end, the following terms are offered to express precise meanings as follow:

Barrel Liner 20: The metal tube through which a projectile or shot charge is fired which bore may be either rifled or smooth. Where rifled, the barrel liner 20 provides material to define the lands 44 and grooves 42. The barrel liner 20 extends from a shank 28 over the radius 26 and over a taper 24 which defines aggressive flutes 22 and fins 23 and finally to a muzzle face 36.

Bore 40: The cylindrical passage the barrel defines the interior of the barrel through which either of a projectile or shot charge is fired. "Smoothbore" weapons (typically shotguns) have no rifling. Most handguns and rifles have "rifling." While the description herein will focus upon rifled barrel assemblies, there is nothing that inherently limits the invention to rifled bores. The same inventive configuration may be used to form a smoothbore barrel assembly.

Breech 50: The end of the barrel liner where the barrel assembly is attached to the action.

Contour: The final exterior shape of the barrel liner along its length.

Crown 34: The shaping of the point on a muzzle where the end of the bore intersects with the muzzle face of the end of the barrel. Crowning 34 is used to provide a protected and uniform edge where the bullet leaves the bore to equalize the force propelling gasses exert on the bullet.

Flute 22: The longitudinal groove formed in the cylindrical exterior surface of a barrel formed by the removal of material, which in conventional barrels form dished shallow grooves in the barrel with widths which are significantly greater than the grooves' depth and having rounded ends; fluting is generally performed for the purpose of reducing weight.

Lands 44 and grooves 42: Referred to together as rifling. Lands 44 are the raised portions between the grooves 42 in the walls of the bore 40. The spiral arrangement of grooves 42 is configured to produce the rifling of the bore 40; the rifling to impart a spin on a projectile as it passes through the barrel's bore 40.

Muzzle 30: The end of the barrel out of which the bullet comes upon firing.

Radius 26: A contoured portion of barrel that provides transition to the muzzle of the taper 24 of the barrel.

Rifling: The spiral grooves 42 cut or swaged inside a gun barrel that gives the bullet a spinning motion upon passage. The metal between the grooves 42 is called a "land" 44. The spirals can have either a left or right twist.

Shank 28: Large cylindrical straight part of the barrel that transitions to contoured portion of barrel. The shank 28 is formed of the breech end of the barrel and generally houses the chamber.

Taper 24 and carbon fiber taper 24' are, respectively, in the instant barrel assembly 10 that part of the barrel liner 20 and the corresponding area of the internal cavity the sheath 60 defines. The taper is notable as it is the region that defines the aggressive fluting 22 and between the flutes 22, defines the fins 23 that the flutes 22 form as interspaces. The sheath 60 is bonded to the fins 23 in the taper 24 with a selected bonding cement 66.

FIGS. 1 through 11 show the barrel assembly 10 as being a combination of the steel barrel liner 20 and the carbon fiber sheath 60 to advantageously set off qualities of each against inherent qualities of the other. Because the inventive design seeks to achieve rigidity and damping of harmonics rather than merely to achieve the lightest possible barrel, the barrel assembly is heavier than some of those conventional wrapped barrels. As stated above, the barrel liner 20 is configured to be of sufficient rigidity and stiffness to, by itself, perform as a barrel true to its point of aim.

The inventive barrel assembly 10 is configured to better amalgamate the qualities of each of steel and carbon fiber. While the inventive carbon fiber sheath 60 surrounds and is bonded to the barrel liner 20, it damps vibration within the barrel liner 20, provides additional strength both to lend longitudinal stiffness to the barrel liner 20 and to confine the elastic expansion of the barrel as the P-wave progresses down the liner. The notable features of the inventive design include the following:

1. The construction of the steel liner is formed with aggressive structural fluting and with heat and cryogenic treatments all stress is removed;
2. The construction of the outer carbon fiber shell provides both longitudinal and circumferential strength while configured in a manner yielding no stress, spine, or memory to it;
3. The assembly process which is stress neutral and in bonding adds a dampening effect to undesirable harmonics; and
4. The final assembly is calculated to prevent the introduction of all stress while the deep fluting dissipates heat well, and will perform exceptionally under conditions far above what even an extreme user would induce.

Figure 12:
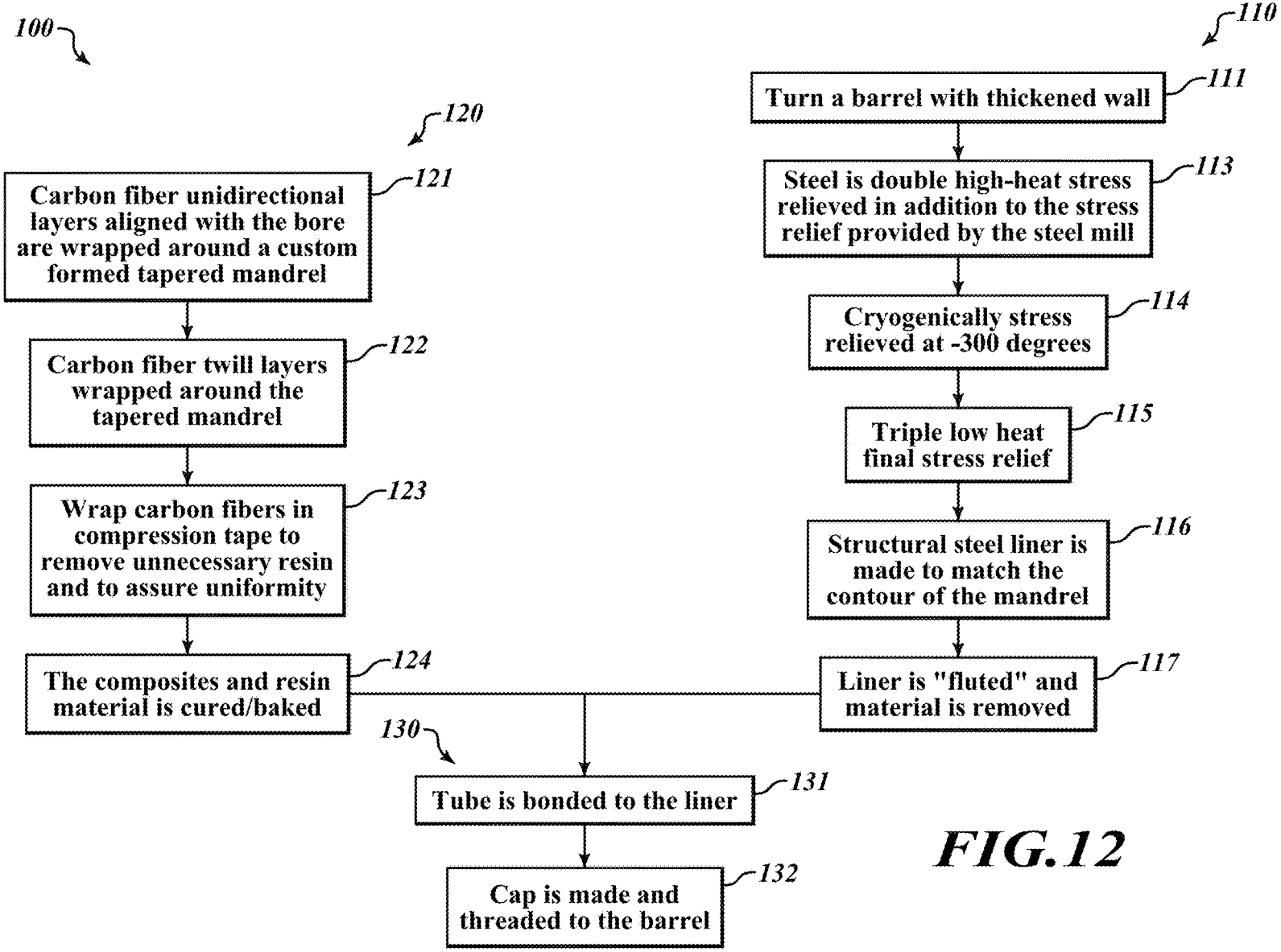
FIG. 12 is a flow chart depicting the method of constructing the inventive barrel assembly.

The method 100 (FIG. 12) of forming the barrel assembly 10 (FIGS. 1, 2, and 6) is depicted in FIG. 12. There are three significant stages, forming the barrel liner 110, forming the carbon fiber sheath 120 and assembling the barrel liner 20 (FIGS. 6, 7 and 8) to form the barrel assembly 10.

In forming the barrel liner 110, a suitable blank must be turned by conventional means at 111. Barrel blanks are cylindrical components of rifled firearms that will ultimately be machined to become a finished barrel liner 20. Barrel blanks go through precision machining operations, which, when done correctly, are highly contributive to the overall accuracy of a rifle. The inventive process relies upon conventional technology to form a barrel liner 20 in a three step process, but includes several stress relief events before being machined to completion. The only notable exception from conventional barrel blank formation is that blanks formed by this method are configured to have significantly thicker walls thereby to provide sufficient material for later removal at the fluting 117 step below.

Gundrilling is a conventional deep hole drilling process, often performed on precision equipment, that allows deeper holes to be drilled more accurately and effectively than with by standard milling. In conventional machining, to assure that the resulting bore 40 will be extremely straight, conventional forming uses counter-rotation of the workpiece and tool to minimize drift during the process. Once again, to this extent, conventional forming methods are applied to produce a gundrilled blank.

While gun drilling is used to assure a very straight bore 40 conventional methods will use a reamer to remove the remaining material necessary to bring the bore 40 to its finish caliber. While there are several conventional methods to so finish the bore diameter, the presently preferred embodiment employs pull reaming process to finish the inside bore of the barrel. While not the exclusive method for forming a suitable blank, pull reaming is preferred as a means to ensure a dimensionally correct inside diameter (ID), as well as a smooth surface finish, thereby to prepare a barrel blank that will enable smooth and accurate firing. A pull reaming tool has multiple cutting edge flutes that remove a minimal amount of material from the inside diameter, and smooth out any cutting marks that may occur during gundrilling. To accomplish this, reaming tools are pulled through the drilled blank to produce an extremely consistent, uniform diameter barrel blank that ultimately will shoot with extreme accuracy.

Reaming is finished by a process known as lapping or honing the bore. The bore lapping process consists of drawing a formed slug impregnated with progressively finer abrasive grits through the bore of the barrel. After completing one of the progressively finer abrasives, the barrel is meticulously cleaned to remove any trace of the abrasive. In each transition there is the rougher (or larger grit) abrasive and the finer (or smaller grit) abrasive. The rougher passes remove imperfections within the metal surface like pits, nicks, lines and scratches. The finer abrasives leave progressively finer lines that are not visible to the naked eye. Lubricants like wax and kerosene may be used as lubricating media during these operations. The reaming is accurate down to the millionth of an inch and the lapping removes any subtle tool marks or imperfections that may still be present after honing.

For optional application of the inventive process to smoothbore blanks, no rifling is necessary. But, in barrels where a bullet rather than a charge of shot is thrown, rifling assures accuracy. Rifling grooves into the length of the barrel bore induces a spiraling action of a bullet when fired, stabilizing the bullet during its flight. Rifle grooves are cut into the bore 40 surface to produce lands 44 and grooves 42 (FIGS. 3, 5, and 7) with a specific pitch or twist rate. There are several ways to introduce grooves to the barrel blank, including button rifling, single point cut rifling, hammer forging, and broach rifling. Despite differences in form, the common goal of rifling is to deliver the projectile accurately to the target. In addition to imparting the spin to the bullet, the barrel must hold the projectile securely and concentrically as it travels down the barrel. This requires that the rifling meet a number of tasks:

- It must be sized so that the projectile will swage or obturate upon firing to fill the bore.
- The diameter should be consistent, and must not increase towards the muzzle.
- The rifling should be consistent down the length of the bore, without changes in cross-section, such as variations in groove width or spacing.
- It should be smooth, with no scratches lying perpendicular to the bore, so it does not abrade material from the projectile.
- The chamber and crown must smoothly transition the projectile into and out of the rifling.

Rifling may not begin immediately forward of the chamber. There may be an unrifled throat ahead of the chamber so a cartridge may be chambered without pushing the bullet into the rifling. This reduces the force required to load a cartridge into the chamber, and prevents leaving a bullet stuck in the rifling when an unfired cartridge is removed from the chamber. The specified diameter of the throat may be somewhat greater than groove diameter, and may be enlarged by use if hot powder gas melts the interior barrel surface when the rifle is fired.

The first method, cut rifling, is that method employed in the presently preferred embodiment of the invention as it presents the most precise method for imparting controlled spiraling groves in the interior of the bore. Cut rifling is the oldest method of rifling a gun barrel. The cut-rifling method removes metal from the surface of the bore to create the grooves using a single-bladed, hook-type cutter of groove width that is pulled through the cold barrel. It is sometimes called "hook rifling" after the fishhook-shaped cutter used. Cutter depth is adjustable, so that it removes only a small amount of metal on each pass. Each groove must be cut individually with multiple passes of the cutter. The cutter is indexed to each groove in turn and positively rotated by the rifling machine using a sine bar.

Among the advantages of cut rifling is the configurability of the process; the shape and number of grooves and groove depth can be easily selected as necessary producing a specific twist rate as may be required. Little or no additional stress is imposed on the barrel in that the cutting does not work the barrel as button rifling might. Cut-rifled barrels may be contoured after rifling.

Nonetheless, while precise, the process is slow and not well adapted to mass production resulting in barrels that normally cost more due to the slower manufacturing process. However, many target shooters prefer cut-rifled barrels in spite of their price due to their uniformity and close tolerance. The cut-rifling method is normally used on prototype or test barrels where only a small number will be made for experimental purposes.

In contrast to cut rifling which removes material in an iterative process to achieve an optimum depth, button rifling forms grooves by working material out of grooves to form lands. Button rifling is a modern method that creates the grooves in the cold surface of a rifle bore by displacing or plowing metal using a bullet-shaped, super-hard button of tungsten carbide. The rifling button has the reverse or "negative" pattern of the groove profile ground into its surface. As the rifling button is pushed or pulled through the barrel, the groove pattern is ironed into the bore surface by displacement. There are several variations in button-rifling procedure. Some barrelmakers prefer to pull the button through the bore, while others prefer to push it through. In most cases, the button remains free to rotate during this process, dependent on the angle of the grooves in its surface to cause the desired degree of rifling twist. As variations in rifling twist may occur during this procedure, some barrel-makers affix the rifling button to a rod and positively rotate it with a sine bar.

Because button rifling groove bores in a manner that is both fast and very economical, as only a single pass of the button is required to rifle a barrel, button rifling is well suited to mass-production methods with high output. Button rifling leaves a smooth, bright finish inside the barrel that need not be lapped. But, button rifling creates stress in a barrel; high-quality button-rifled barrels must be stress-relieved after rifling. In the presently preferred embodiment, however, the hot and cold stress relieving addresses these stresses.

Buttons are expensive and difficult to make. Different groove configurations and different rifling twists require a new button. While button-rifled barrels can be extremely accurate; more bench-rest records are held by shooters using guns with button-rifled barrels than by any other type but such is not because of any natural superiority of button rifling but because of the greater number of button rifled barrels available. Button-rifled barrels are very common on modern centerfire and rimfire guns.

Broach rifling is a modern, production-oriented variant of cut rifling that addresses some shortcomings of the cut-rifling process. While cut rifling uses a single-bladed cutter, a broach is a metal bar with sets of progressive cutting blades in its outer surface corresponding to the number of grooves. The cutting blades are fixed in spiraled succession, each blade cutting to slightly greater depth than the one in front of it. As the broach is pushed or pulled through the cold barrel, all the grooves are simultaneously cut on a single pass of the several passes necessary to form the grooves. In some cases, a series of ever-larger broaches is run through the barrel until the desired groove depth is reached. Unfortunately, however, broach rifling has not been successful to produce barrels of match-grade accuracy. Because broach rifling was well-suited to high-volume production, it was the rifling system of choice in making military rifles during the first half of the 20th century. In the second half of the 20th century, button rifling replaced broach rifling for the manufacture of rifle barrels, with few exceptions. Today, broach rifling is commonly used to rifle some handgun barrels.

After the barrel blank production 110 is completed, the blank undergoes a heat treating operation 113 to relieve the stress introduced in the machining process. While all working of the blank introduces stress, any cold forming process such as rifling introduces the largest amount of stress. There are a number of techniques to rectify stress-related anomalies, but the most basic parameters used to redistribute the effects of stress are a combination of time and temperature. During this stress relieving process, barrels are aligned to maintain straightness, and heated to a temperature based on the barrel liner 20 material, then brought back down to ambient temperature in a controlled time process. Carbon steels may be stress relieved by holding a temperature at 1100 to 1250° F. (600 to 675° C.) for 1 hour per inch (25 mm) of thickness. Stress relieving offers several benefits. For example, when a component with high residual stresses is machined, the material tends to move during the metal removal operation as the stresses are redistributed. After stress relieving, however, greater dimensional stability is maintained during machining, providing for increased dimensional reliability. Stress relieving by heat treating 113 the barrel blanks ensures that the barrel will hold its straightness and dimensions as it is fluted and finished into a rifle barrel liner 20, and installed and used on a functioning firearm accurately and reliably. Elimination of stress within the material is extremely important because any stress may cause deformation of the barrel when heated by burning propellant in use.

As stated above, the machining and cutting of the barrel blank, as well as plastic deformation, will cause a buildup of stresses in a material. These stresses could cause unwanted dimension changes if released uncontrolled as in use. The barrel blank is stress relieved to minimize stresses (performed after any working machining) as well as to minimize the risk of dimension changes. Stress relieving is conventionally done after rough machining, but before final finishing such as polishing or grinding. In the case of the inventive process, to assure complete straightness of the resulting barrel liner bore 40, the blank is double heat treated at 113. Dimensional stability is necessary to achieve the precision to fully realize the benefits of the inventive barrel assembly 10 so double heat treating assures the greatest available stress relief.

After being drilled, reamed, rifled, and stress relieved, parts are considered barrel blanks. In order to finish these barrel blanks into a rifle barrel liner 20, these blanks undergo a series of subsequent conventional operations. Contouring, chambering and finishing will turn the blank into a barrel liner 20. No further explanation is necessary here as conventional means achieving these processes will be used to form the barrel liner 20.

At the molecular level, these strenuous metal "working" events cause microscopic gaps where some molecules are displaced and out of phase with one with another. Ultimately, if not stabilized these thermal and physical stresses can reduce the strength and toughness of the metal barrel, making them more susceptible to cracking and other forms of mechanical failure. While heat treating stress relief 113 can address some of these issues, cryogenic stress relief 114 has proven to allow the molecular matrix to cure itself of the above-described displacements. Cryogenic stress relief 114 increases the density of metal materials, making them stronger and more solid. In the case of these barrel blanks, cryogenic stress relief 114 yields dramatic improvements in the precision and durability of the resulting barrel assembly 10.

Cryogenic metal stress relief 114 supplements the heat treated stress relief 113 in the inventive process and completing those metallurgical changes begun by heat treating. In addition to removing residual stresses in treated materials, cryogenic stress relief also improves wear resistance and corrosion resistance. Treated parts will also have lower distortion tendencies, and will, in most cases, become significantly stronger and tougher. The cryogenic stress relief 114 is advantageous in that the barrel blanks may be re-machined or re-ground indefinitely without altering the effects of the cryogenic stress relief process. Cryogenic stress relief 114 alters the molecular grain microstructure of the entire metal part, not just the surface layer, thereby improving toughness, dimensional stability, and wear properties of metal parts.

In performing cryogenic metal stress relief, the formed barrel blanks are placed in a specially constructed tank. Then, liquid nitrogen is introduced to lower the temperature inside the tank to −300° F. (−184° C.) for a selected interval until the necessary target temperature is reached. The required cooling period is determined by conventional means taking into account the type of metal being treated and the thickness of the material. The rifle blanks are then slowly returned to room temperature.

Having completed the cryogenic stress relieving 114, the barrel blanks are additionally stabilized with a triple low heat stress relief 115. The triple low heat stress relief 115 exploits the molecular changes introduced by cryogenic stress relief 114 and prepares the barrel blanks for their final nonworking machining, transforming the barrel blanks into barrel liners 20. While this final heat treating will exceed 300 degrees Fahrenheit (149° C.) though it may be employed at temperatures as high as 700 degrees Fahrenheit (371° C.). Because the last two machining steps do not significantly "work" the metal, this low heat stress relief is the last action to affect the molecular structure of the barrel blank. Material removal in the final two steps will not affect the stability and stress-free nature of the blank.

Figure 6:
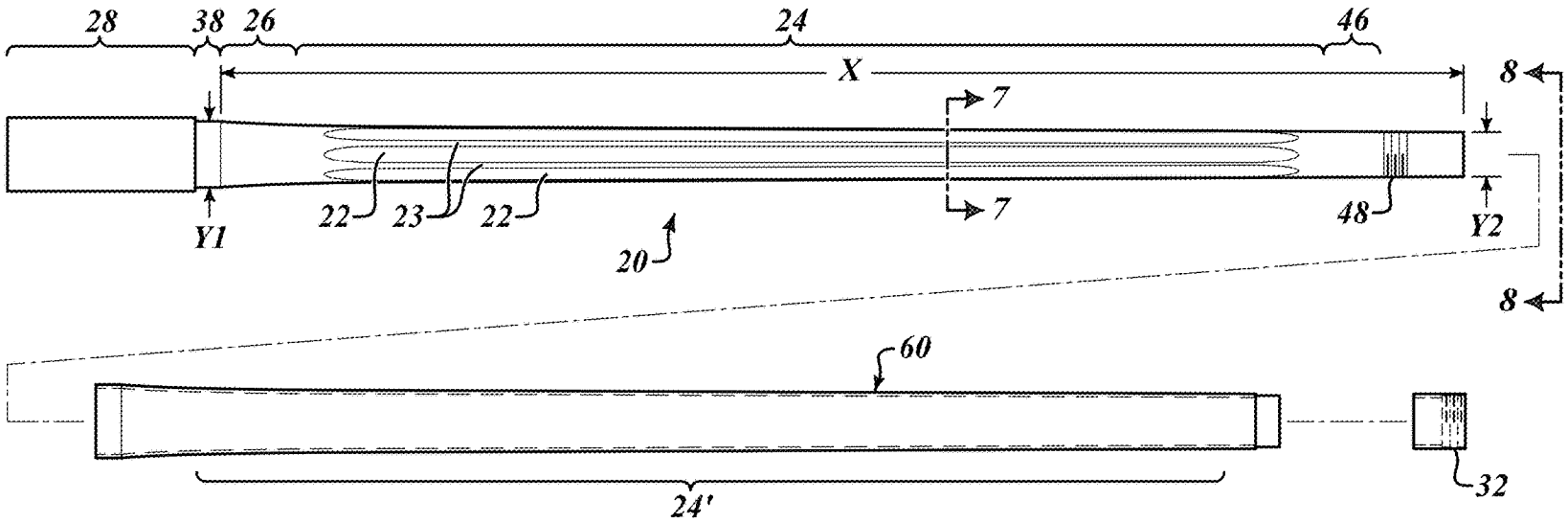
FIG. 6 is an exploded diagram of the inventive barrel assembly.

As is evidenced in FIG. 6, the barrel assembly 10 relies upon the insertion of the barrel liner 20 into the carbon fiber sheath 60. Further, as is evident in FIGS. 3 and 4, intimate contact between the carbon fiber sheath 60 and the enclosed barrel liner 20 is necessary to achieve the objects of the invention. Both the support and damping functions of the carbon fiber sheath 60 cannot be adequately achieved without continuous even contact between these two components. Precise machining enables the carbon fiber sheath 60 to properly impart both support and damping. To that end, the contour of the barrel, at 116, is turned to exactly match the contour of a mandrel used to form the carbon fiber sheath 60. Indeed, both the mandrel and the barrel blank can be turned on the same lathe to provide absolute consistency and therefore achieving that contact in the barrel assembly 10 between barrel liner 20 and the carbon fiber sheath 60.

Returning, then, to the formation of the barrel liner 20. The thickness of the original barrel blank was selected to be more than sufficiently rigid to provide shot after shot accuracy in spite of heating through use. The rigidity of a steel tube is heavily dependent on wall thickness and outside diameter. Normally, fluting reduces wall thickness, which does reduce its mass, but also reduces rigidity. Conventional fluting is generally shallow such that the depth of flute is less than half the width. But, even conventional fluting results in a fluted barrel that if compared to a nonfluted barrel of the same weight, the fluted barrel would be more rigid since it would have a much greater outside diameter. The greater the outside diameter, all other things being equal, the stiffer the barrel. Understanding, then, that the removal of material will reduce the rigidity of the barrel, the question then is where to remove the material to retain as much rigidity as possible. Because the bending stress increases linearly away from the neutral axis until the maximum values at the extreme fibers at the top and bottom of the beam, preserving the material at positions furthest from the bore 40 preserves the greatest rigidity within the barrel liner 20.

In the presently preferred embodiment, the fluting is strictly longitudinal or what are known in the industry as straight flutes. While the straight flutes are preferred, the inventive barrel liner 20 can be practiced with helical flutes as well in that helical flutes do not compromise stiffness to a significant extent. A combination of these two patterns, known as "straight with a twist" will also suffice. Another hybrid pattern is known as "helical interrupted". Diamond fluting is simply the overlay of two helical flute patterns having opposite "handedness", i.e. a right hand helix overlaid with a left hand helix to produce fins that have a diamond appearance.

Unlike conventional fluting, the fluting that occurs at 117 is unconventionally deep. To better understand the structure of the resulting barrel liner 20, let us consider the bending stress acting on a beam. Compressive and tensile forces develop in the direction of the beam axis under bending loads. These forces induce stresses on the beam. The bending stress is zero at the beam's neutral axis, which is coincident with the centroid of the beam's cross section, in this case, the axis of the bore 40. The bending stress increases linearly away from the neutral axis until the maximum values at the extreme fibers at the top and bottom of the beam. The maximum compressive stress is found at the uppermost edge of the beam while the maximum tensile stress is located at the lower edge of the beam. Because of this area with no stress and the adjacent areas with low stress, using uniform cross section beams in bending is not a particularly efficient means of supporting a load as it does not use the full capacity of the beam until it is on the brink of collapse. Wide-flange beams (I-beams) and truss girders effectively address this inefficiency as they minimize the amount of material in this under-stressed region.

Figure 7:
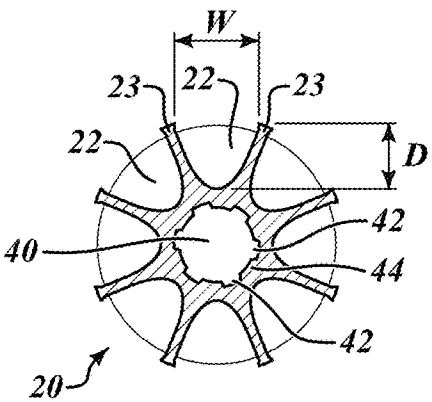
FIG. 7 is a cross-section view of the barrel liner depicting fluting of the barrel liner.
Figure 10:
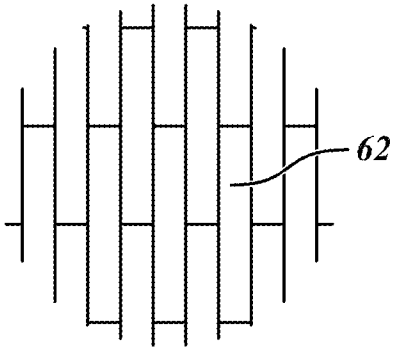
FIG. 10 is a surface detail of unidirectional carbon fiber making up layers of the carbon fiber sheath.
Figure 11:
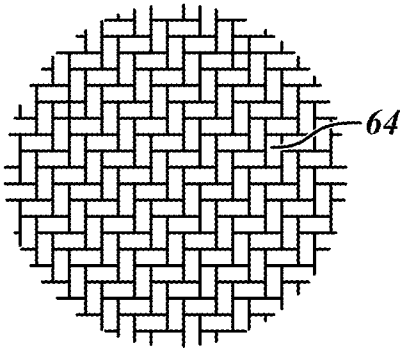
FIG. 11 is a surface detail of carbon fiber twill making up layers of the carbon fiber sheath.

The fluting 117 is preserves significant material at the furthest distance from the bore 40 axis thereby preserving the greatest rigidity. FIG. 7 shows, in cross-section, the barrel liner 20 looking towards the muzzle 30. The flutes 22 are shown as having a depth D and width W and being generally triangular. Importantly, the depth D and width W are selected so that depth D is at least equal to if not exceeding the width W and because of these dimensions, the fluting 22 defines deep fins 23 with the remaining material. These fins 23 serve the same function as webs in I-beams so the barrel liner 20 remains nearly as rigid in spite of the material removed by fluting 22.

The deep flutes 22 also offer a great deal more surface area to the air allowing the barrel liner 20 to serve as a heat sink. The fins 23 expose the heat within the barrel liner 20 to air giving up heat by convection. A fin of a heat sink may be considered to be a flat plate with heat flowing in one end and being dissipated into the surrounding air as it travels to the other. In general, the more surface area a fin 23 presents to the air, functioning as a heat sink, the better it works.

Figure 8:
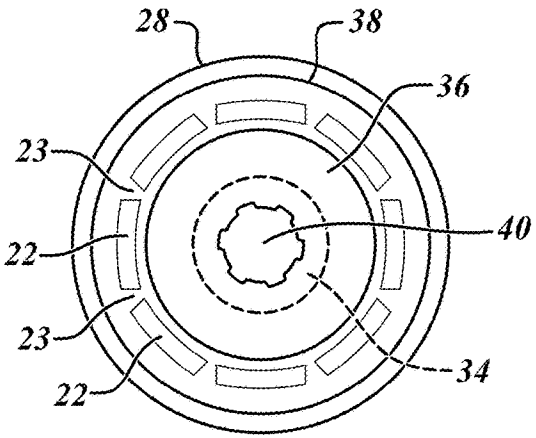
FIG. 8 is an end view depicting the inventive barrel liner showing a muzzle face viewing down the bore to the breach.

The method then progresses to the formation 120 of the carbon fiber sheath 60. At 121, the system relies upon the mandrel (formed as discussed above) matching the contour of the shoulder 38, radius 26, taper 24 and the tenon 46. As stated above, the mandrel can be turned on the same lathe as the is used to turn the barrel blank. The matching of contours between the barrel liner 20 (esp. FIG. 8) and the mandrel assures that the carbon fiber sheath 60 will uniformly contact the barrel liner 10 along the shoulder 38, radius 26, taper 24 and the tenon 46, and the corresponding interior surface of the carbon fiber sheath 60 as the barrel assembly 10 is assembled as shown in FIG. 6 to result depicted in FIGS. 1 and 2.

Figure 9:
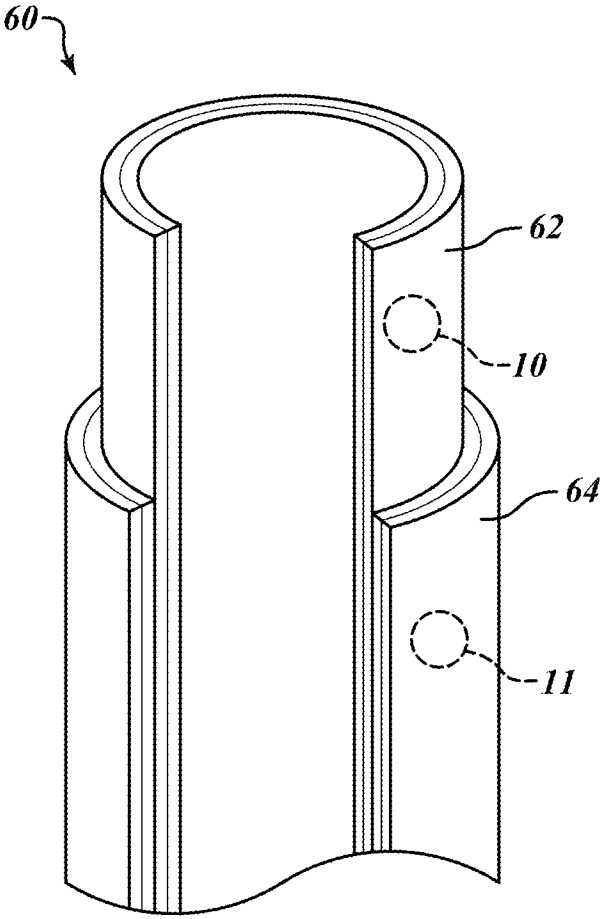
FIG. 9 is a cut away view of the carbon fiber sheath indicating the construction of the carbon fiber sheath.

FIG. 9 depicts the carbon fiber sheath 60 formed at 121 by the wrapping of unidirectional carbon fiber 62 (FIG. 10) around the mandrel (not shown) to align with the long dimension of the barrel liner 20, or, in wrapping, its alter ego in formation, the mandrel. In the presently preferred embodiment, a second wrapping of unidirectional carbon fiber 62 is employed to lend greater longitudinal rigidity.

Figure 3:
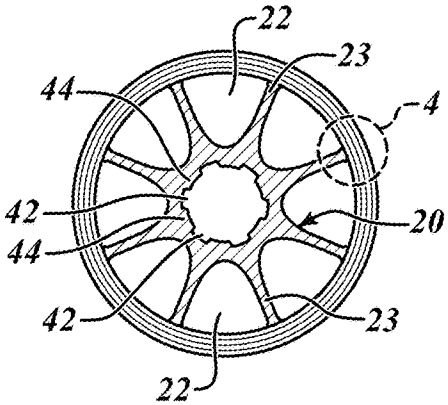
FIG. 3 is a cross-section view of the inventive barrel assembly oriented towards the muzzle.

When each shot is fired, the chamber swells and produces an "annular wave" or "pressure pulse" which then bounces back and forth along the barrel liner 20 between the muzzle 30 and breech 50. For this reason, at 122, the presently preferred embodiment comprises, also, a first and second wrap of carbon fiber twill 64 (FIG. 11) orthogonally to the unidirectional fiber 62. As such, the formation of the sheath 20 with such carbon fiber twill 64 will give the sheath what is known as hoop strength. FIG. 3 shows each of the unidirectional fibers 62 and carbon twill 64 encircling the barrel liner 20.

Fiber reinforced composite materials are generally used in highly-efficient structures such as aircraft, automotive parts and pressure vessels due to their high specific strength and stiffness. Pressure vessels made of wrapped carbon fiber can be widely observed in civilian industries; for instance, in fire extinguishers, oxygen gas tanks, natural gas cylinders, etc. A common feature among these products is that they must withstand high pressure under working conditions, while considering an appropriate standard safety factor. These vessels are generally made up of resin-impregnated rovings or tows and are wound over a rotating male mandrel. The mandrel can be any shape that does not have reentrant curvature. Its reinforcement may be wrapped either in adjacent or overlapping bands which cover the mandrel's surface.

Experimental investigations show that the fiber orientation has a pronounced effect on the mechanisms associated with deformation of the barrel liner 20. In some laminates that are often termed "fiber dominated," ultimate failure is controlled by fiber failure. This ultimate failure is often preceded by matrix failure, which occurs by the matrix developing cracks between the fibers. While the matrix cracking softens the laminate, the overall structural integrity of the laminate appears in many cases to be preserved by the plies with more favorable orientations, than are those loaded primarily in the fiber direction. Thus, where the fibers encircle the barrel liner 20 as showing in FIG. 3 and FIG. 4, the carbon fiber twill 64 provides hoop strength to resist the expansion of the barrel liner 20 as the P-wave transits the barrel liner 20. The fibers within the twill 64 that encircle the barrel liner 20 prevent its expansion in something of the same manner that a belt prevents expansion of a torso after a Thanksgiving dinner. Resisting the expansion of the barrel liner 20 assures that the bullet exits the crown 34 at the same instant on all sides. Expansion at any one spot will add an impetus to the bullet that causes the bullet to yaw away from the expansion upon exit from the barrel liner 20. Yawing will cause the bullet to deviate in its flight. Hoop strength, therefore, prevents that yawing and renders the bullet's path to be more accurate and repeatable in flight.

At 123, compression table wraps the unidirectional fibers 62 and carbon twill 64 even as they encircle the barrel liner 20. By using compression tape any unnecessary resin is also removed. Resin will hold heat in the finished sheath 60 even as the carbon fiber conducts it away from the metal barrel liner 20. Thus, by reducing the amount of unneeded resin, use of compression tape allows the resulting sheath 60 to exploit carbon fibers' natural conductivity dispose of excess heat by convention. In forming the sheath 60, the finished layered structure is secured onto the mandrel by a coil of compression tape that is removed subsequent to curing. The coil of compression tape can be such as polyamide tear-off tape. There is a great advantage to applying a coil of compression tape that can then be removed after curing. Not only will the shape retain its form precisely until it has cured, but the laminations will also be compacted, air will be forced out of it, and the impregnation of the layers will be more uniform. The coil of compression tape is pulled tight enough to prevent any air bubbles from remaining in the laminations because any air inclusions between the laminations entail a lower load-supporting capacity. Thus, the coil is subjected to powerful tension. As a result of the pressure the tape exerts, the unidirectional fibers 62 and carbon twill 64 will harden into a uniformly thick and without voids around the mandrel. When the compression tape is removed, the cured carbon fiber sheath will not be significantly stressed.

At 124, the unidirectional fibers 62 and carbon twill 64 are cured in an oven of some description known as an autoclave. Autoclaving is a process that ensures the highest quality of carbon fiber reinforced polymer composite structures. During the autoclave process, consolidation of unidirectional fibers 62 and carbon twill 64, through simultaneous elevated pressure and temperature, results in a uniform high-end material system. The autoclave gives a neat uniform structure with controlled size of voids or no voids at all.

Generally for autoclaves, the usual processing procedure for curing is to firstly increase pressure and right afterwards heating the autoclave at a chosen heating rate to the desired temperature. According to most fluids behavior, the viscosity of the matrix will decrease with this temperature rise. As a result, at an elevated temperature, the resin will freely flow, facilitating the consolidation process until eventually the chemical cross-linking starts occurring and forming gelation. At this point, the resin will soon change from a liquid into a solid, and it will start preventing viscous flow. It is, therefore, important that the chemorheology of the prepreg resins is known in order to complete consolidation and volatile removal prior to resin gelation. For example, the first dwell is performed to prolong the time range for consolidation and eventually to prereact the matrix to reduce the risks of large exotherms. The second dwell is the actual cure step. Most commercial epoxy-based prepreg systems require cure temperatures of 121° C. or 178° C. The application of pressure assists the consolidation and helps suppress voids in the laminates.

Figure 4:
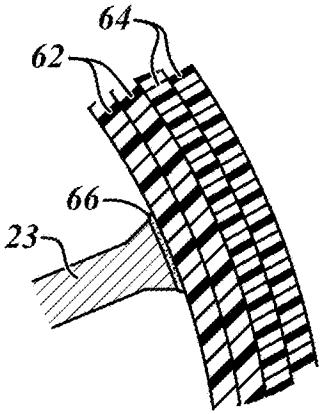
FIG. 4 is a detail of the cross-section of the inventive barrel assembly showing the bonding of barrel liner to the carbon fiber sheath.

When cured, the consolidation of the carbon sheath 60 by bonding to the barrel liner 20 forms the barrel assembly 60. As shown in FIG. 4, the barrel liner 20 is bonded to the carbon fiber sheath 60 with a cement 66 adhering the fins 23 to the unidirectional carbon fiber 26 the carbon fiber sheath 60 comprises. In a presently preferred embodiment, the selected cement is a two-component, industrial grade epoxy adhesive, Henkel® EA E-40HT, as this adhesive incorporates a flexant, extremely high shear and adhesion strength, and a high temperature rating. Importantly, this epoxy adhesive has a 2.2% elongation at break which allows the barrel liner 20 to expand in response to heat without breaking the bond to the carbon fiber sheath 60. The tensile strength at break is determined, in accord with the testing in ISO 527, to be 30 $N/mm^2$ or 4,300 psi. Because of the precision of machining both of the mandrel and the barrel liner 20, the carbon fiber sheath 60 can conform one to another to mate with an average bondline gap of 0.1 to 0.2 mm. Any embodiment will include a suitable cement having an excellent resistance to shear and impact forces. Additionally, the cement 66 will have elevated temperature resistance as the barrel liner 20 will readily heat the fins 23 in response to propellant combustion as described above.

Once fully cured, the barrel assembly 10, a threaded steel spacer or cap 32 (FIGS. 2 and 6) is threaded onto the barrel liner 20 at the muzzle 30 to provide a solid seating surface for muzzle attachments and ease machining for the gunsmith for attachment of such as a suppressor. In one embodiment, threading for this cap 32 can be extended to the muzzle face 36 to serve as a mount for such barrel attachments. With the installation of the cap 32, the barrel assembly 10 is complete.

The biggest complaint heard by makers of conventional carbon wrapped or sleeved barrels, is that they suffer from point of impact shifts or accuracy degradation as the barrel warms up through use. This happens often in less than 5 rounds and in most cases less than 10 rounds. Through extensive testing, the barrel assembly 10 described herein does not suffer point of impact shifts in the same way. While shifts in point of impact do occur as the barrel assembly 10 is heated in use, this shift is much less dramatic. In testing, the number of shots necessary to heat the barrel assembly to effect the measurable point of impact shift may be as many as ten times those of conventional carbon fiber barrels.

Apart from its inherent stiffness to support the barrel, the carbon fiber sheath 60 enjoys the vibration-damping behavior especially given the selected arrangement of both unidirectional 62 and symmetric angle-ply 64 carbon fiber-epoxy laminates. Damping is a key feature that characterizes the dynamic behavior of fiber-reinforced composites accomplishing the minimization of resonant vibrations within the barrel assembly 10. By selective arrangement of the fibers, the carbon sheath 60, will dissipate energy through the viscoelastic character of the matrix.

Since the gun barrel assembly 10 components are subject to severe dynamic loads, vibration control is desirable. The disclosed barrel assembly 10 enjoys a high degree of damping in a structure that can improve performance of the steel barrel liner 20 in a dynamic load environment. Vibrations do not propagate as readily due to fiber arrangement, because damping occurs due to movement within the fiber/matrix interface, i.e., the energy that moves plies of viscoelastic allowing the barrel assembly 10 to bleed energy by thermoelastic damping. Composite materials, such as laminated carbon fiber, possess high degree of material damping compared with conventional materials such as steel. So, while steel might ring, the carbon fiber serves to damp down vibrations so that the bullet will travel by a truer path. The damping is enhanced due to the internal friction among the constituents and interfacial slip at the fiber-matrix interfaces, while the fiber contributes to the stiffness to the overall barrel assembly 10.

The embodiments of the invention in which an exclusive property or privilege is claimed are defined as follows:

1. A method for forming a carbon fiber barrel sleeve resiliently bonded to a steel liner comprising:

providing a rifle barrel having walls sufficiently thick to accommodate cutting a plurality of flutes into an exterior surface of the barrel;

providing a mandrel blank;

turning each of the rifle barrel and mandrel blank on a lathe to form, respectively, a barrel liner and a mandrel such that each has a substantially identical contour;

stress relieving the barrel liner to eliminate stresses within a molecular structure of the barrel liner;

cutting the plurality of flutes into the exterior surface of the barrel liner, the flutes being generally longitudinal and configured such that the depth of each flute is at least equal to the depth of the flute and defining fins in an interspace between adjacent flutes;

laying up a plurality of layers of carbon fiber fabric on the mandrel to form a sheath;

curing the sheath; and bonding the sheath to the barrel liner with a continuous bond at tips of the fins, the bonding by application of a high temperature adhesive.

2. The method of claim 1 wherein stress relieving the barrel liner includes at least one application of high heat stress relief by heating the barrel liner to approximately at 1100 to 1250° F. (600 to 675° C.).

3. The method of claim 2 wherein stress relieving the barrel liner includes two applications of high-heat stress relief.

4. The method of claim 2 wherein stress relieving the barrel liner includes cryogenic stress relief after high-heat stress relief, the cryogenic stress relief including bringing the barrel liner to approximately −300° F. (−184° C.) in temperature.

5. The method of claim 4 wherein stress relieving the barrel liner further includes, after cryogenic stress relief at least one application of low heat stress relief in excess of 300 degrees Fahrenheit (149° C.).

6. The method of claim 1 wherein laying up a plurality of layers of carbon fiber fabric includes laying up at least one layer of unidirectional carbon fiber fabric to be oriented so carbon fibers are aligned with an axis of the mandrel.

7. The method of claim 1 wherein laying up a plurality of layers of carbon fiber fabric includes laying up at least one layer of carbon fiber twill such that some of the carbon fibers are oriented to encircle the mandrel.

8. The method of claim 1, wherein the high temperature adhesive is an epoxy having strength characteristics including an approximately a 2% elongation at break.

9. A carbon fiber barrel assembly comprising:

a barrel liner having flutes cut longitudinally into an exterior surface of the barrel liner, the flutes being generally longitudinal and configured such that a depth of the flutes is at least equal to a width of the flutes, the flutes defining fins in interspaces between adjacent flutes; the barrel liner, further, having a barrel liner contour and being formed of a stress-relieved steel alloy;

a carbon fiber sheath comprising a plurality of layers of carbon fiber fabric having been laid up and cured on a mandrel; the mandrel having a contour substantially identical to the barrel liner contour; and a high temperature adhesive being uniformly present at tips of the fins and employed to bind the barrel liner to the carbon sheath.

10. The carbon fiber barrel assembly of claim 9 wherein the stress-relieved steel alloy is a steel alloy which has been subjected to at least one application of high heat stress relief by heating the barrel liner to approximately at 1100 to 1250° F. (600 to 675° C.).

11. The carbon fiber barrel assembly of claim 10 wherein the stress-relieved steel alloy is a steel alloy which has been subjected to two applications of high heat stress relief.

12. The carbon fiber barrel assembly of claim 11 wherein the stress-relieved steel alloy is a steel alloy which has been subjected cryogenic stress relief after high-heat stress relief, the cryogenic stress relief including bringing the barrel liner to approximately −300° F. (−184° C.) in temperature.

13. The carbon fiber barrel assembly of claim 12 wherein the stress-relieved steel alloy is a steel alloy which has been subjected after cryogenic stress relief at least one application of low heat stress relief in excess of 300 degrees Fahrenheit (149° C.).

14. The carbon fiber barrel assembly of claim 9 wherein the plurality of layers of carbon fiber fabric includes laying up at least one layer of unidirectional carbon fiber fabric to be oriented so carbon fibers are aligned with an axis of the mandrel.

15. The carbon fiber barrel assembly of claim 9 wherein the plurality of layers of carbon fiber fabric includes laying up at least one layer of carbon fiber twill such that some of the carbon fibers are oriented to encircle the mandrel.

16. The carbon fiber barrel assembly of claim 9 wherein the cement includes a high temperature adhesive being an epoxy having strength characteristics including an approximately a 2% elongation at break.

17. A method for forming a carbon fiber barrel assembly, the method comprising:

turning a bored, reamed and rifled barrel blank to have a barrel liner contour, the barrel liner contour extending from a shoulder proximate to a breach to a tenon proximate to a muzzle and extending over a radius and taper, the barrel liner contour configured to be substantially cylindrical at each of the tenon and shoulder;

fluting the turned barrel blank with substantially longitudinal flutes, the each one of the flutes having a depth at least equal to a width the flute has, the flutes situated to define fins in an interspace between adjacent flutes;

applying a coating of cement to uniformly cover at least a radial extremity of the fins, the shoulder and tenon; and binding the barrel blank to a carbon fiber sheath laid up, formed and cured on a mandrel having a contour substantially identical to the barrel liner contour.

18. The method of claim 17 wherein:

turning the barrel blank further includes:

stress relieving the barrel liner with at least one application of high heat stress relief by heating the barrel liner to approximately at 1100 to 1250° F. (600 to 675° C.);

cryogenically stress relieving the barrel liner including bringing the barrel liner to approximately −300° F. (−184° C.) in temperature; and low heat stress relieving the barrel blank after cryogenically stress relieving by heating the barrel blank to a temperature in excess of 300 degrees Fahrenheit (149° C.).

19. The method of claim 17 wherein fluting the barrel blank includes:

fluting in a pattern selected from a fluting assortment consisting of straight, helical, straight with a twist, interrupted helical, and diamond patterns.

20. The method of claim 17 wherein the cement includes a high temperature adhesive comprising an epoxy having strength characteristics including an approximately a 2% elongation at break.

* * * * *